US005104007A

United States Patent [19]

Utter

[11] Patent Number: 5,104,007

[45] Date of Patent: Apr. 14, 1992

[54] ICE AND BEVERAGE DISPENSING APPARATUS

[75] Inventor: Robert P. Utter, Lake Villa, Ill.

[73] Assignee: Scotsman Group, Inc., Vernon Hills, Ill.

[21] Appl. No.: 501,018

[22] Filed: Mar. 29, 1990

[51] Int. Cl.[5] ..... F25C 5/00

[52] U.S. Cl. ..... 222/146.6; 222/240; 222/242

[58] Field of Search ..... 222/146.6, 239, 240, 222/242, 367, 368, 369, 370

[56] References Cited

U.S. PATENT DOCUMENTS

| | | | |
|---|---|---|---|
| 989,348 | 4/1911 | Haines | 222/236 |
| 1,778,845 | 10/1930 | Brunhoff | 222/239 X |
| 2,134,664 | 10/1938 | Heitshu | 222/370 |
| 3,101,872 | 8/1963 | Dickinson | 222/146.6 X |
| 3,211,338 | 10/1965 | Weil et al. | 222/146.6 X |
| 3,798,923 | 3/1974 | Pink et al. | 62/344 |
| 3,874,559 | 4/1975 | Pink | 222/146.6 |
| 3,881,642 | 5/1975 | Hoenisch | 222/370 |
| 4,619,380 | 10/1986 | Brooks | 222/146.6 X |
| 4,679,715 | 6/1987 | Hovinga | 222/517 |
| 4,694,661 | 9/1987 | Landers | 222/146.6 X |
| 4,930,685 | 6/1990 | Landers | 222/370 |
| 4,969,583 | 11/1990 | Torimitsu et al. | 222/146.6 X |
| 4,981,237 | 1/1991 | Landers | 222/146.6 X |

OTHER PUBLICATIONS

"Machine Devices and Instrumentation", Chironis, A. P., McGraw-Hill, New York, 1966, title and pub. pages and pp. 2-5, 16-20, 28-31 and 36-41.

Three drawings by Queen Products (King-Seeley Thermos Co.): (a) Drwy. No. 02-2617-01, entitled "Bin-STorage", (dtd. 3/15/'80) and noted as the CD-450 Model; and Drwg. (dtd. 7/12/'80) and noted as the CD-20 Model; and (b) Drwg. No. 02-2567-01 (dtd. 7/31/'79), entitlted Bin-Rotor.

*Primary Examiner*—Donald T. Hajec

*Assistant Examiner*—Anthoula Pomrening

*Attorney, Agent, or Firm*—Harness, Dickey & Pierce

[57] ABSTRACT

An ice handling and beverage dispenser includes an agitator assembly mounted within a downwardly sloping ice storage bin, the assembly including a rotor connected to an agitator with the agitator comprising a frame to sweep the ice and the rotor having a plurality of circumferentially arranged L-shaped ice moving scoops. The agitator assembly is rotatably driven by a motor adjacent a front wall of the bin whereby ice is lifted by the scoops from a location adjacent the bottom of the bin to an outlet chute thereabove. When used in a beverage cooling dispenser, the sweep arm "sweeps" the bin wall whereby ice is caused to fall onto a cold plate disposed therebelow.

31 Claims, 5 Drawing Sheets

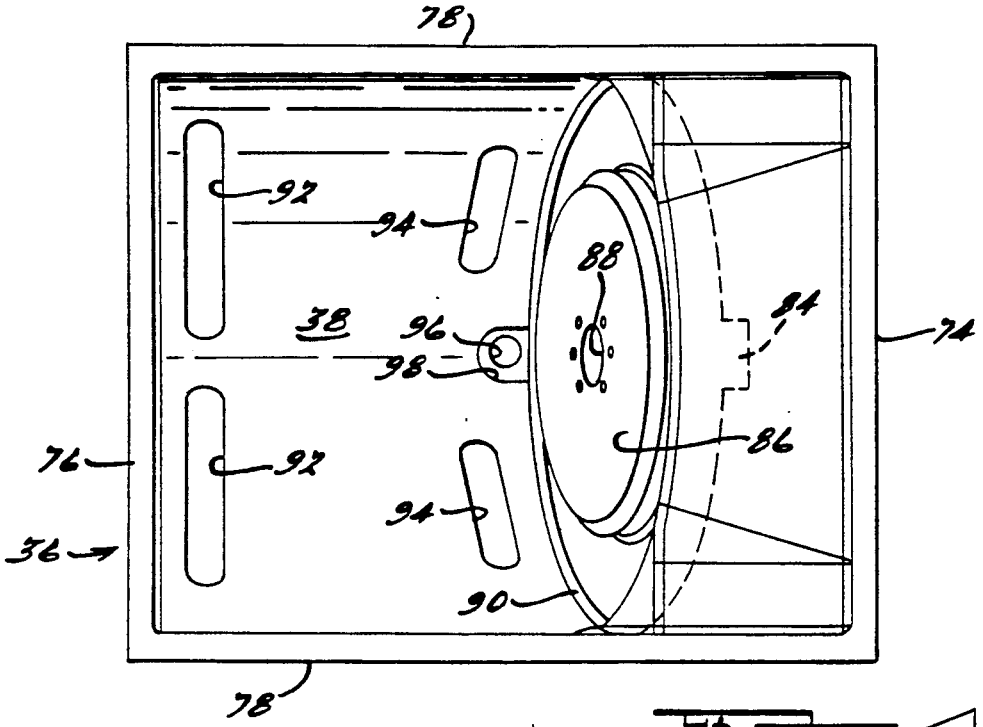
FIG. 4.
FIG. 6.
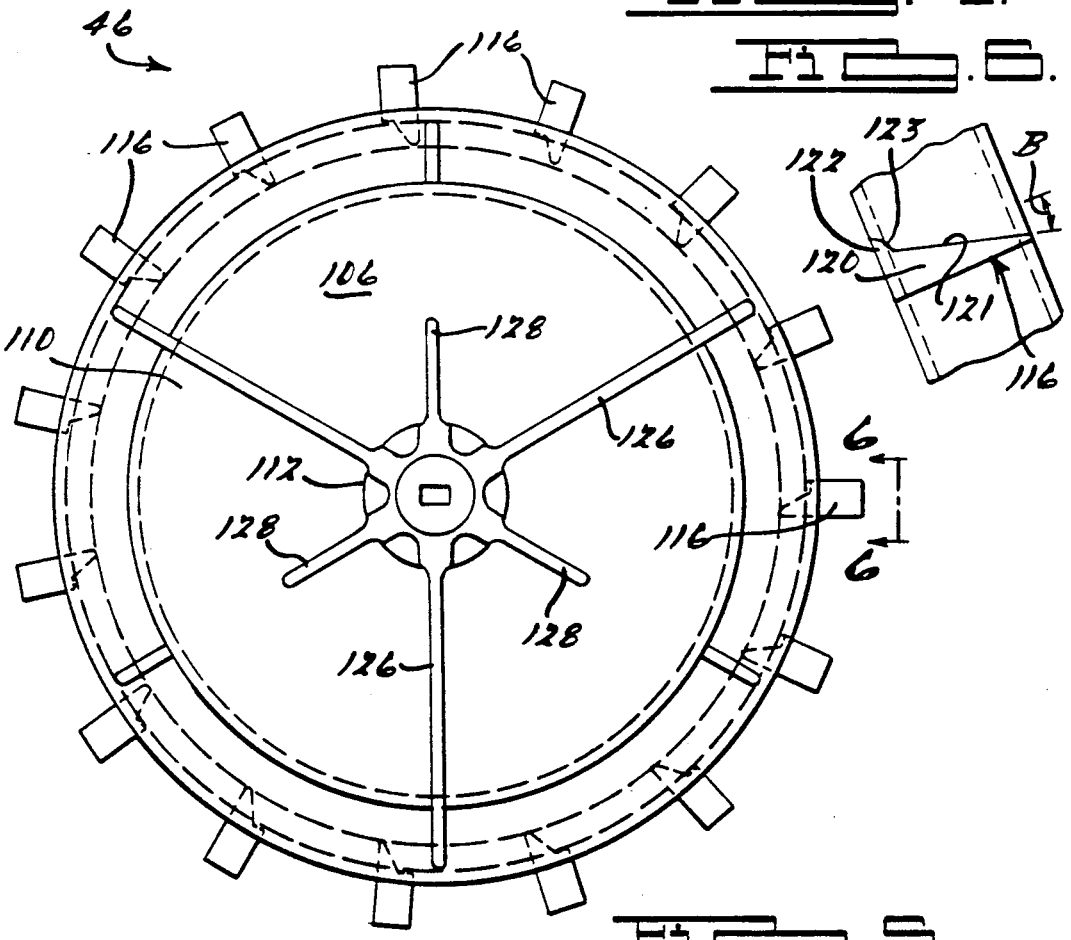
FIG. 5.

ICE AND BEVERAGE DISPENSING APPARATUS

BACKGROUND AND SUMMARY OF THE INVENTION

This invention relates to an ice handling apparatus of the counter-top type that stores ice in cube and nugget form in an insulated sanitary container, and dispenses predetermined quantities of cubed or nugget ice upon demand, and to combined ice handling and beverage dispensing apparatus that cools beverages using cubed or nugget ice falling by gravity onto a cold plate, and dispenses cooled beverages. Cube ice is defined as either traditional batched process cube ice or continuously processed compressed nuggets.

Apparatus for dispensing ice alone, and of both ice and cooled beverages, is known. A machine having a cylindrical drum and shutter arranged to "vend" a predetermined quantity of ice cubes from a common mass of cubes in a storage bin is shown in "Ice Vending Machine", U.S. Pat. No. 3,272,300, issued Sept. 13, 1966 to Hoenisch. A single scoop was formed between flat and cylindrical walls of the drum and thus allowed for only one ice delivery for each rotation thereof.

A machine for dispensing both ice and cooled beverages is shown in "Cold Plate System for Ice Dispenser", U.S. Pat. No. 4,300,359, issued Nov. 17, 1981 to Koeneman et al. Ice falls by gravity through a vertical conduit whereby to fill the conduit and fall onto the center of a horizontally disposed cold plate therebelow. It is very important that the beverage be maintained at a particular temperature if the product to be dispensed is acceptable. To achieve this end, the beverages are passed through the cold plate and cooled to a certain temperature. Maintaining a uniform layer of hard ice on the cold plate is important to assure adequate cooling of the carbonated water and syrup running through the tubes in the cold plate. The Koeneman cold plate may not always be totally covered with ice due to the ice fall arrangement.

Another problem in apparatus of the type herein is that even with an insulated storage bin, because of various external factors, the ice can melt to a certain extent. The melting of the ice can result in a water drainage problem and a tendency of the ice to adhere and become fused. This is particularly so in systems using ice in crushed or flaked form. Consequently, an agitator is provided to agitate the stored ice to prevent fusion. Systems using a spiral-helix type auger in combination with semi-cylindrical ice supporting liner are known. The spiral auger drives the ice in a generally horizontal path across the liner, oftentimes resulting in too much "handling" of the ice, causing the ice to break down and deteriorate. Small particles of ice are very hard to dispense and are prone to melt.

A principal object of the present invention is to provide ice cube and nugget dispensing apparatus incorporating agitating and dispensing means which will be capable of continuously dispensing ice in cube or nugget form.

Still another object is provision of an ice dispensing arrangement to cause the ice to be dispensed with the least amount of breakage as possible.

Another object of the invention is provision of a combination ice cube and nugget dispensing and ice cube agitating means which is responsive to a control signal whereby to agitate without dispensing the ice cubes.

Another object of this invention is provision of a unique rotor configuration for agitating ice cubes to prevent their becoming frozen and delivering ice cubes from a storage bin to a discharge chute without any accompanying water.

Another object of this invention is provision of an ice and beverage dispensing apparatus wherein an ice agitating means assures that the ice does not become solid but also supplies ice as needed to a cold plate for cooling beverages.

In accordance with this invention there is provided an ice dispenser of the type including a hopper or storage bin for storing a quantity of ice cubes, an agitator mounted in the hopper for maintaining the ice in free-flowing form, the agitator including a sweep arm that is connected to a rotor for rotation therewith. The sweep arm extends into the hopper to pick up the ice and rotate it around the inside circumference of the bin. The rotor is mounted to the hopper for rotation about a primary axis and for dispensing ice from the hopper. The rotor comprises a flat circular plate having a central hub mountable to a motor shaft extending through the front wall of the hopper, a plurality of raised ribs to engage and lift the ice, and a plurality of radially extending "scoops" disposed around the circumference thereof, rotation of the rotor operating to dispense ice from the full circumference of the rotor. The scoops move the ice within the bin from a location adjacent the bottom wall of the bin toward an outlet located vertically thereabove at the top of the bin. Ice slides down an arcuately-shaped bottom surface of continuous unbroken curvature defining the storage bin and is picked up by a lip on each scoop of the rotor and is rotated to the top of the bin for discharge therefrom.

Further and in accordance with this invention is a combination ice handling and beverage dispensing apparatus, comprising that recited for the ice handling and dispensing apparatus and further comprising a container for holding a quantity of ice, a cold plate in the container, and the hopper including a plurality of openings for allowing ice to fall by gravity from the hopper to the container whereby to maintain a supply of ice in the container and in contact with the cold plate. The sweep arm facilitates entry of ice into the openings whereby to fall into the container and distribution of the ice on the top face of the cold plate.

An advantage of the present rotor is elimination of an auger/wire helix apparatus which requires excessive axial "handling" of the ice, which causes ice to break down, and deteriorate into small particles of ice which are hard to dispense. The sweep arm and the raised ribs on the rotor tend to rotate through the ice and let it free fall into place, contrary to that of the spiral auger/wire helix which pushes the ice into a discharge opening.

A water drain line connects to the hopper and the cold plate to advantageously drain water from the machine whereby to obviate ice from becoming solid or water at 32° F sitting on top of the cold plate instead of hard ice cubes.

Another advantage is that the ice cubes used to maintain the necessary temperature in the cold plate are not dispensed.

Other objects and advantages of the present invention will become apparent from the following detailed description taken in conjunction with the accompanying drawings.

BRIEF DESCRIPTION OF THE DRAWINGS

FIG. 4 is a plan view of an ice storage bin of the apparatus.

FIG. 5 is a plan view of a rotor.

FIG. 6 is a detailed view showing an ice moving scoop of the rotor taken along line 6—6 of FIG. 5.

DETAILED DESCRIPTION OF THE PREFERRED EMBODIMENT

The principles of this invention are directed equally to apparatus for handling and dispensing ice and also to a combined apparatus for handling and dispensing ice and cooling and dispensing beverages. Because the unique features of the ice handling and ice dispensing apparatus are included in the combined ice and beverage dispensing apparatus, the discussion herein will be directed to the combined ice and beverage dispenser with the differences being noted when appropriate to distinguish the combined ice and beverage dispenser from the ice dispenser alone.

Figure 1:
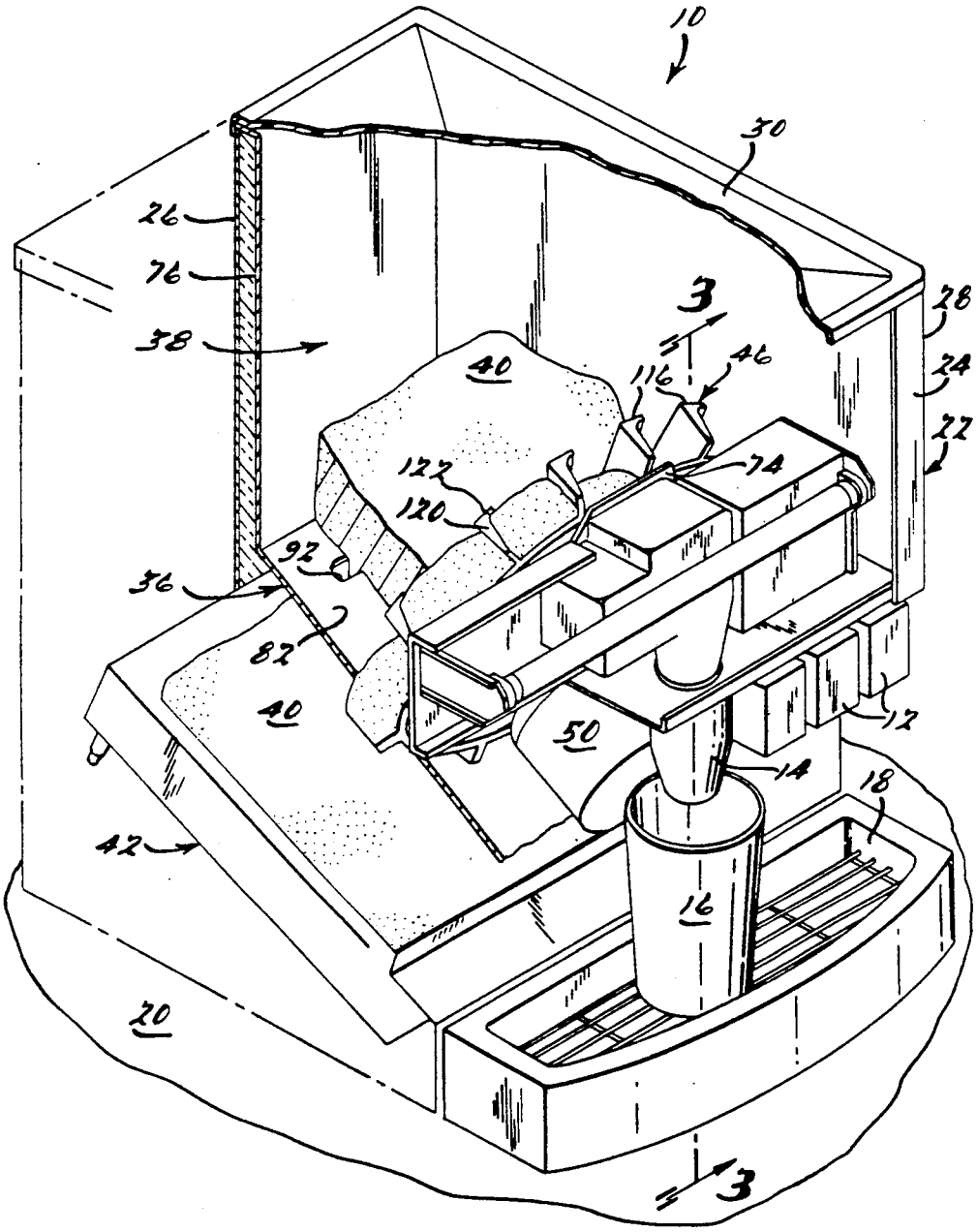
FIG. 1 is a cut-away perspective view of an ice handling and beverage dispensing apparatus in accordance with the present invention.
Figure 2:
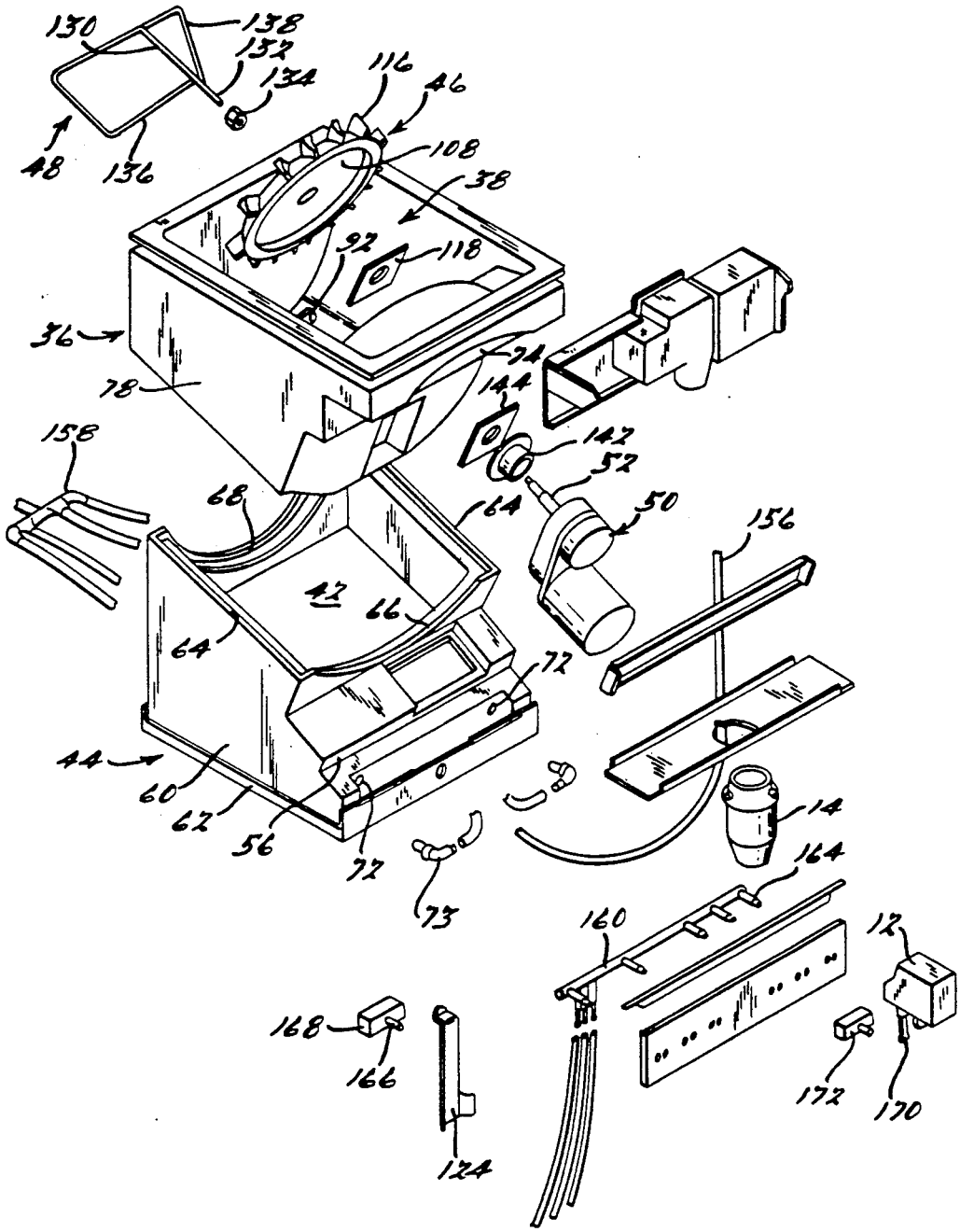
FIG. 2 is an exploded perspective view of the apparatus of FIG. 1.
Figure 3:
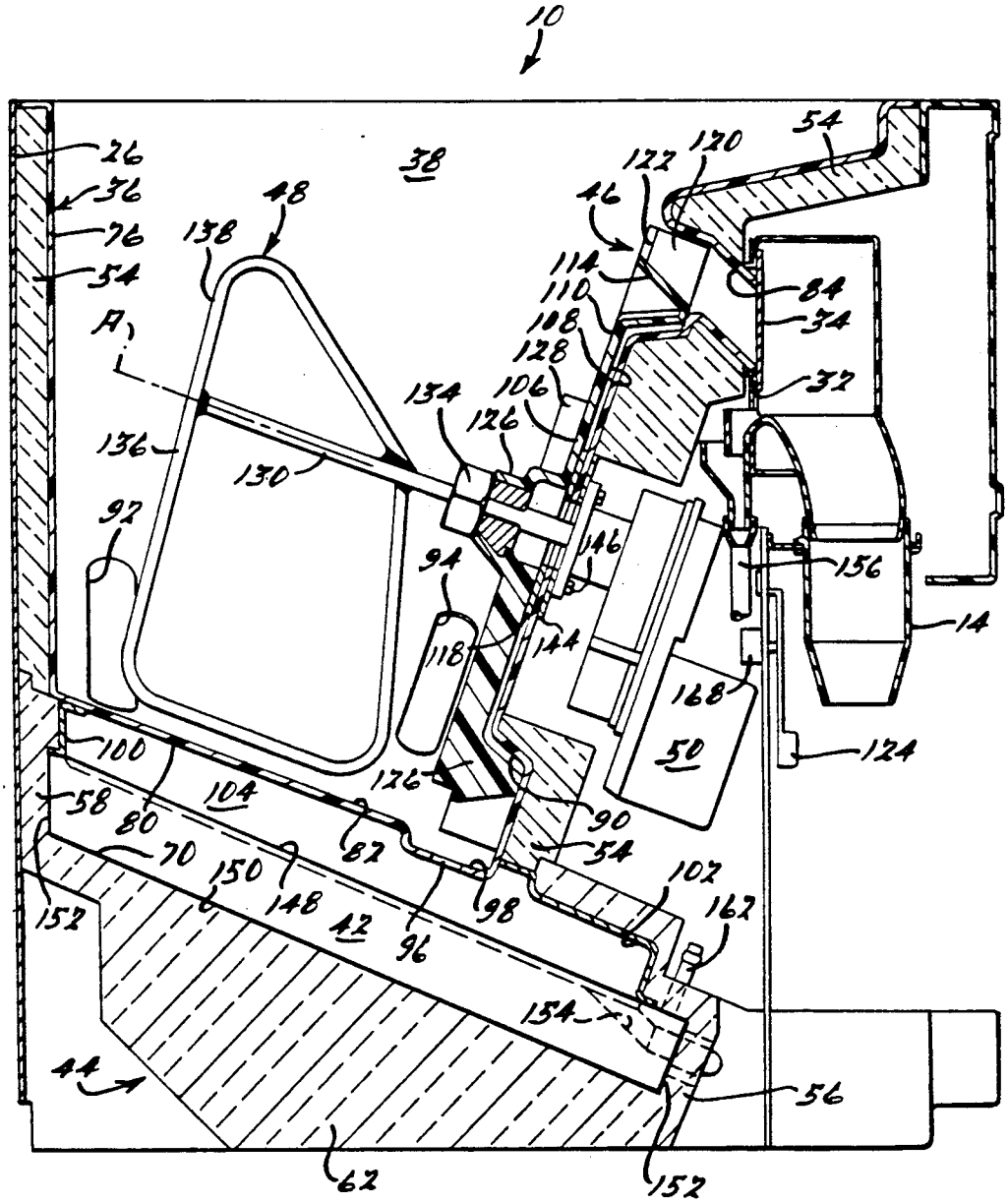
FIG. 3 is an elevation view in section generally taken along line 3—3 of FIG. 1.

Referring now to the drawings, and in particular to FIGS. 1-3, a combined ice handling and ice dispensing and beverage cooling and beverage dispensing machine 10 positions several beverage dispensing valves 12 and an ice delivery chute 14 adjacent the front thereof for dispensing the desired product to the user. As shown in FIG. 1, a cup 16 is positioned under the chute for receipt of ice and above a drain sink 18. The machine is adapted to be mounted on the flat counter-top 20 of a stationary storage cabinet or on a movable cart (not shown).

The machine comprises a substantially rectangular metal outer housing 22 which includes longitudinally spaced front and rear walls 24 and 26 and laterally spaced side walls 28 (one shown) which extend vertically upward from a base to form an open top adapted to receive ice placed therein by the user and be closed by a lid 30. Alternatively, the open top could be configured to support a conventional ice cube making apparatus (not shown). Front wall 24 is provided with a discharge chute 32 to deliver ice to delivery chute 14 and a solenoid actuated door 34 which moves between a closed position (as shown in FIG. 3) to an open position, respectively, to prevent and permit ice to pass from discharge chute 32 to delivery chute 14.

The housing 22 encloses a hopper 36 which forms a storage bin 38 for storing a large mass of potable cubed ice 40, a cold plate 42, a generally rectangular shaped cradle 44 for positioning the cold plate and supporting the hopper vertically above the cold plate, a cylindrical rotor 46 for scooping up ice in the hopper and delivering the ice to the discharge chute, a sweep arm 48 for agitating the ice, and an electric motor 50 having a driveshaft 52 for simultaneously rotatably driving the rotor and sweep arm together as a unit. The ice 40 is desirably in cubed form to minimize melting and problems associated with scooping up flaked and crushed ice. Preferably, a mass of polyfoam material 54 is used in the embodiment shown to surround portions of the hopper and cradle to thermally insulate the inner space of the housing to inhibit the ice from melting.

The cradle 44 is integrally formed of a polymeric material such as polyethylene and includes a front wall 56 longitudinally spaced from a rear wall 58 and pair of side walls 60 with each of the walls 56, 58 and 60 extending generally vertically upward from a base 62 whereby to form an open top upon which to support the hopper and define an enlarged interior cavity within which to receive the cold plate. The side walls 60 each terminate in generally straight surfaces 64 which slope vertically downward and longitudinally forward from rear wall 58 to front wall 56 and the front and rear walls 56 and 58 terminate, respectively, in arcuate surfaces 66 and 68 that extend laterally between the respective straight surfaces 64, the straight and arcuate surfaces 64, 66 and 68 defining a frame for supporting the hopper. An interior surface 70 of base 62 is disposed at an acute angle to the horizontal plane of counter-top 20 to support and position the cold plate for receiving ice and draining water when ice should melt. Surface 70 is at an acute angle of approximately 20°-24° and preferably about 22° to the horizon. Several openings 72 extend through front wall 56 of the base 62 to drain water from the cold plate. As shown, a pair of elbows 73 are used to drain the water.

Hopper 36 is integrally formed of a polymeric material such as polyethylene and includes a front wall 74 spaced longitudinally from a rear wall 76, a pair of lateral side walls 78 and a semi-cylindrical wall or base 80 having a semi-cylindrical surface 82 forming a smooth downward continuation of side walls 78. The front, rear and side walls 74, 76 and 78 are upwardly open to receive ice 40 in storage bin 38 and have their respective lower ends configured to nestingly seat on the corresponding surfaces 64, 66 and 68 of cradle 44. The semi-cylindrical wall 80 is oriented so as to slope vertically downwardly and longitudinally forward from rear wall 76 to front wall 74. Preferably, the axis and semi-cylindrical surface 82 are at the above stated acute angle to the horizon. Front wall 74 includes a discharge chute 84 at a location vertically upward from the lowermost position of semi-cylindrical surface 82, chute 84 being interfitted within discharge chute 32. Front wall 74 is generally perpendicular to the semi-cylindrical wall 80 and includes an interior face 86 having an opening 88 therethrough sized to receive driveshaft 52 of gear motor 50, and an annular recess having an inclined cylindrical face 90 facing radially outward from opening 88.

The semi-cylindrical surface 82 of base 80 is provided with several elongated slots 92 and 94 through which ice cubes can fall and a drain hole 96 for draining water to the bottom of the cradle. The slots 92 and 94 are elongated and generally rectangular in shape with each extending in a direction transverse to a vertical plane passing through the axis of rotation of rotor 46 and approximately midway between side walls 78, each slot being angularly offset from the vertical plane through the hopper. Drain hole 96 is formed in a cup-shaped recess 98 at the lowermost portion of wall 80.

A pair of angled brackets 100 and 102 are provided to support hopper 36 above cold plate 42 whereby to define a suitable cavity 104 to receive ice from the hopper through slots 92 and 94. The semi-cylindrical surface 82 of the hopper is spaced vertically upward from the cold plate and is in parallel relation thereto.

Rotor 46 is integrally formed of a suitable material, such as polypropylene, and includes a generally circular plate 106 having flat forward and rearward faces 108 and 110, a central hub 112 through which the rotor axis of rotation "A" passes, and an outer circumference partially defined by a cylindrical V-shaped annular wall 114 and provided with a plurality of radially outwardly extending flanges or scoops 116. The rotor is mounted adjacent to interior face 86 of front wall 74 of hopper 36 such that forward face 108 is abutted against a bearing plate 118 and V-shaped annular wall 114 is nested for rotation within the annular recess including inclined face 90. Rearward face 110 is directed rearwardly towards bin 38 so as to be engaged by the ice 40.

The scoops 116 are generally "L" shaped and each includes a body 120 and a foot 122, the feet 122 being disposed in a plane generally including rearward face 110 and the respective bodies 120 being disposed in respective planes that are generally perpendicular to front wall 74 and which pass through the axis of rotation "A". The cylindrical V-shaped annular wall 114 and the respective bodies 120 space the feet 122 from interior face 86 of the front wall 74 a predetermined distance whereby to define an ice captivating pocket. The scoops 116 are adapted to be rotated into contact with the ice whereby to engage the ice in the hopper 38 and lift the ice upward to a point vertically thereabove and where discharge chute 84 is disposed. Because ice in storage bin 38 flows by gravity from rear wall 76 forwardly to front wall 74, all of the ice will be centered at the lowermost portion of the bin. Rotation of rotor 44 ensures that all of the ice in the hopper will be scooped up. The circumferentially arranged scoops assure that ice is always available for use.

The rotor in the embodiment shown includes fifteen ice pick-up pockets arranged equiangularly about the circumference. As shown in FIG. 6 respective surfaces of the leg and body are at an acute angle and intersect one another. As ice slides down the center of the hopper, ice is picked up by a tapered leading edge 123 or "lip" of each foot 122 and delivered to face 121 of body 120, disposed at an acute angle "B" to the Vertical plane through the scoop 116 and axis of rotation. Additionally, depending on the level of ice in the hopper, ice is continuously picked by all of the L-shaped scoops 116 as they rotate from the bottom of the hopper to the discharge chute vertically thereabove, whereupon the angled V-shaped wall and angled position of the discharge chute cooperate to let the ice fall by gravity to the door. With ice pick-up at the bottom of the hopper, a greater ice storage capacity is provided.

When the rotor 46 is being rotated, by the user depressing an ice dispenser lever 124, the solenoid actuated door 34 receives a signal and the door opens and ice falls by gravity into the ice delivery chute 14 vertically therebelow. When the lever is not depressed, the door is driven closed and ice dispensing is stopped.

A plurality of ribs extend upwardly from rearward face 110 to agitate and lift ice as the rotor rotates. As shown, three long ribs 126 and three short ribs 128 are spaced equiangularly and extend radially from central hub 112. The ribs tend to pick up the ice and let it fall into place. Advantageously, alternative rib designs and locations can be provided as needed.

Sweep arm 48 comprises a one-piece metal frame including an axial shaft 130 having an end portion 132 threadably secured to the motor shaft 52 extending through the hub 112 and a pair of shaped ice engaging portions in the form of a U-shaped bail 136 and a V-shaped bail 138 which sweep through the ice mass to cause the ice to remain in a free-flowing form. The central axis of shaft 130 is generally coaxial with the axis of rotation "A" and the ice engaging portions 136 and 138 are disposed in a common plane passing through shaft 130 and the axis of rotation of the rotor. The ice engaging portions 136 and 13 cooperate with slots 92 and 94 in hopper 36 to ensure that ice is "swept" into the slots for passage by gravity downwardly and onto cold plate 42 without excessive handling which could break up the ice and to fill cavity 104.

The sweep arms 136 and 138 pick up and rotate ice around the inside circumference of the hopper whereby the ice falls through the four slots 92 and 94 to be uniformly distributed onto the top of the cold plate. The ice tends to "free fall" into place and not be forced or pushed into any discharge opening, as is the case with a spiral auger. Ice falling into slots 92, furthest rearward from wall 74, assures that ice will be supplied to the furthest rearward top surface of cold plate 42 and ice will be supplied by the agitator rotation until the plate temperature reaches the desired level.

Electric gear motor 50 is mounted to front wall 74 of hopper 38 and drive shaft 52 thereof extends through opening 88 in front wall 74 to be operably connected to rotor 46. For this purpose a hub assembly 142, a seal 144 and bearing plate 118 are used in conjunction with threaded fasteners 146 whereby to secure the motor onto front wall 74.

The cold plate 42 is generally rectangular, comprised of aluminum to enhance heat transfer, and includes generally planar top and bottom faces 148 and 150, four generally planar side walls 152, and a plurality of syrup passing lines (not shown) for passing and cooling water, syrup and the like between the rear and front side walls thereof. Bottom face 150 seats on top interior surface 70 of cradle 44. Top face 148 is generally flat and includes a pair of drain holes 154 adjacent the front wall of the plate to communicate water from melted ice through front wall 56 to elbows 73. Drain holes 154 communicate drain water from the two elbows 73 to drain water to the rear of the machine 10 via flexible tubing (not shown). Additionally a drain line 156 is provided to communicate ice which melts from adjacent discharge chute 32.

A cold plate does not function effectively with 32° F. water sitting on the top surface of the plate. Cooling of the cold plate cools carbonated water and syrup passing through the plate. The double drain system on the cold plate sitting at approximately 22° assures that no water at 32° F. sits on top face 148 of the cold plate.

It is to be understood herein that an ice handling and ice dispensing machine would not include the slots 92 and 94 and would not include the cold plate 42. In some applications, the rotor 46 and sweep arm 48 could be sold separately or together as a subassembly for use in both the ice dispensing machine and in the combined ice and beverage dispensing machine 10.

An inlet manifold 158 including a water line and three carbonation lines are connectable to the rear end face of cold plate 42. An outlet manifold 160 communicates cold beverages to the soda dispensing valves 12. A syrup outlet 162 from the cold plate is shown in FIG. 3. A syrup outlet line 164 is shown adjacent the front end wall of cold plate for connection to a syrup dispenser.

A control system (not shown) is provided to periodically rotate the rotor 46 and sweep arm 48 in response to a signal, such as time or temperature, or rotate the rotor and the sweep arm in response to the user making a request for ice. Details of the circuit are within the skill of those in the art and forms no part of the invention. Ice dispensing lever 124 is mounted to front wall 74 for actuating a switch 166 on a microswitch 168 to discharge ice. Similar levers 170 and switches 172 are associated with each syrup dispensing valve 12.

Figure 7:
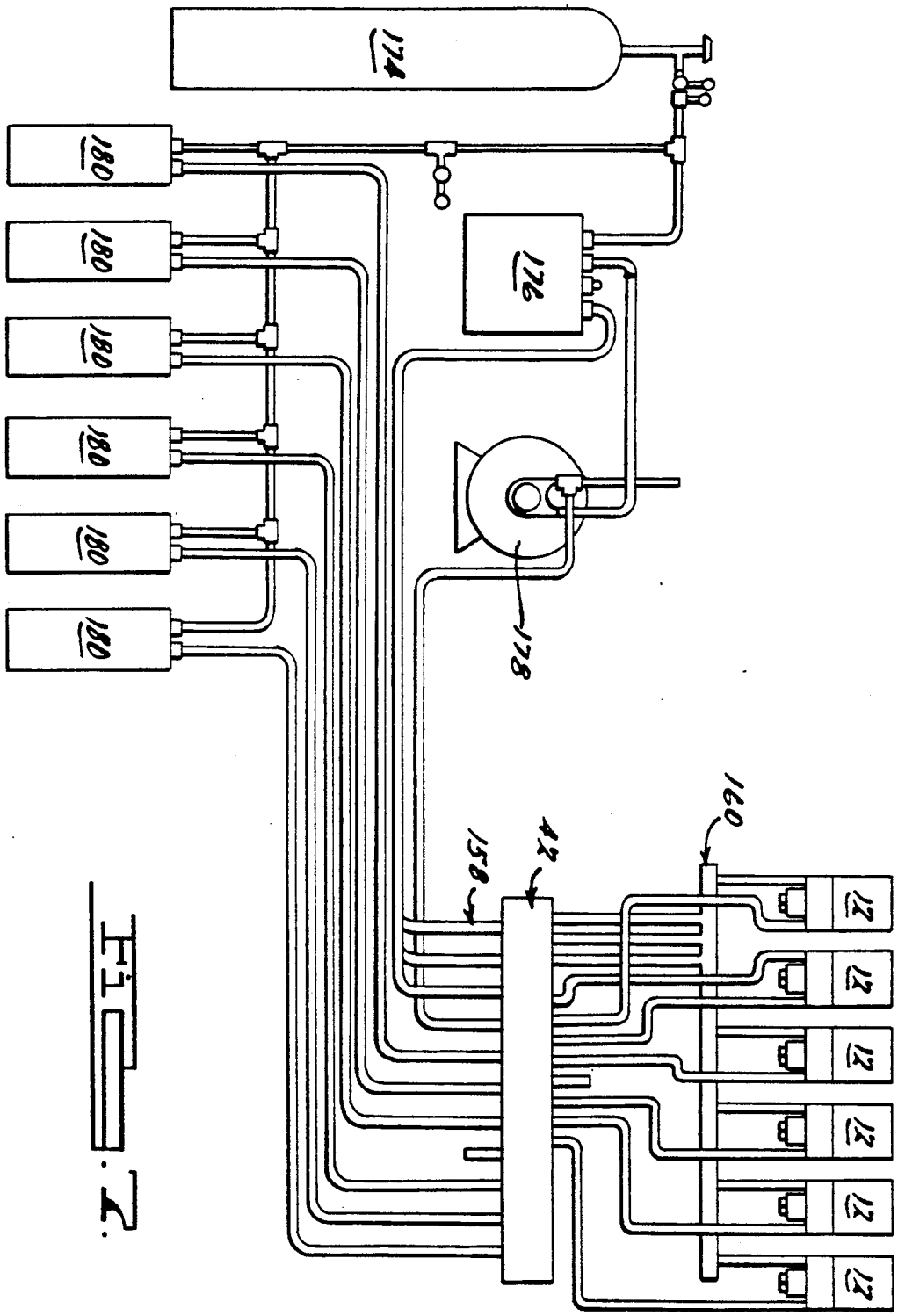
FIG. 7 is a schematic showing the path of beverage syrup and carbonated water through the system.

FIG. 7 shows a schematic of combined ice and beverage dispensing apparatus 10 including a $CO_2$ supply 174, a carbonator tank 176, a water supply 178, syrup tanks 180 associated with respective soda valves 12, and cold plate 42. Respective lines interconnect the $CO_2$ and the syrup with associated lines in cold plate 42 and with associated soda valves 12.

Although it is apparent that the preferred embodiment of the present invention is well calculated to provide the features and advantages stated above, it will be appreciated that the invention is susceptible to modification, variation, and change without departing from the proper scope or fair meaning of the appended claims.

What I claim is:

1. Apparatus for delivering ice from a first position to a second position vertically above the first position, comprising a rotor having a planar wall, an outer circumference, and a central hub, said planar wall being adapted to be mounted in a generally vertical plane and for rotation about a generally horizontal axis of rotation passing through said hub, and a plurality of angularly spaced, L-shaped, material moving members each extending radially outwardly from said circumference to move ice from said first position to the second position upon rotation of the rotor.

2. The invention as recited in claim 1 wherein said outer circumference is defined by an annular V-shaped wall that projects upwardly from the plane of said planar wall, and said L-shaped members are integral with and project radially outwardly from said V-shaped wall.

3. The invention as recited in claim 2 wherein each said L-shaped member comprises a foot and a body, each said foot being disposed in a common plane parallel to the plane of said planar wall and each said body being disposed in a respective plane that passes through said axis of rotation.

4. The invention as recited in claim 3 wherein each said foot has a first surface and each said body has a second surface, said first and second surfaces being adapted to engage the ice as the rotor rotates.

5. An agitator assembly for agitating and moving ice and adapted to be mounted for rotation in a hopper which stores ice to be dispensed therefrom, said assembly comprising a rotor having an axis of rotation disposed horizontally and an outer circumference, a plurality of ice moving elements projecting radially outwardly from the circumference, and an agitator projecting generally perpendicularly upwardly from said rotor for agitating the ice in the hopper upon rotation of said rotor, each said element being generally L-shaped in cross-section and cooperating with the outer circumference to form a scoop for scooping and lifting ice when the rotor rotates.

6. The agitator assembly as recited in claim 5 wherein said rotor comprises a flat circular disc that has generally planar top and bottom faces, and said agitator projects upwardly from one said face.

7. The agitator assembly as recited in claim 6 wherein the outer circumference of said rotor comprises an annular wall of V-shaped cross-section that extends upwardly from a plane including said disc, and said ice moving elements extend radially outwardly from said annular wall.

8. The agitator assembly as recited in claim 6 wherein said rotor includes a central hub and is adapted to be mounted for rotation about said hub, and said agitator has a first portion extending generally axially along said axis of rotation, and an ice engaging portion disposed radially outwardly from said first portion and from said axis.

9. The agitator assembly as recited in claim 5 wherein said agitator includes a plurality of ice engaging portions each being disposed in a common plane including said axis, said portions being interconnected to form a planar frame.

10. The agitator assembly as recited in claim 9 wherein said frame includes a central axial shaft extending coaxially from an end portion thereof connected to said rotor, and a U-shaped bail depending radially from said shaft.

11. In combination with an ice dispenser of the type having a hopper for storage of a mass of hard potable cubed ice, said hopper including generally vertically disposed forward and rearward end walls and a semi-cylindrical wall extending rearwardly and upwardly between said end walls whereby ice will slide vertically downwardly on the semi-cylindrical wall by gravity and pass from a vertically higher first position adjacent to the rearward end wall to a vertically lower second position and in centered relation against the forward end wall, agitator means in the hopper for agitating the ice, a cold plate vertically below the hopper for receiving and cooling beverages, first outlet means for dispensing ice from the hopper for consumption by a user, said first outlet means including an outlet chute connected to said forward end wall, second outlet means for conveying ice from the hopper onto the cold plate to maintain a supply of hard ice in contact with the cold plate, material moving means mounted to said forward end wall and simultaneously movable with said agitator means for scooping ice, said material moving means comprising a flat disc having an outer circumference and a plurality of L-shaped scoops projecting radially outwardly from the circumference, said disc having top and bottom faces and the bottom face being disposed against said forward end wall, and said scoops being adapted to rotate in a path about the semi-cylindrical wall whereby to scoop up the ice which has slid down the semi-cylindrical wall and collected at said lower position and vertically lift portions of said ice therefrom and into operable relation with said chute, and control means responsive to a change in the temperature of the cold plate for periodically driving the agitator means.

12. The invention as recited in claim 11 wherein said second outlet means comprises said semi-cylindrical wall including a plurality of elongated slots for passing said potable ice onto said cold plate.

13. The invention as recited in claim 11 wherein said first and second outlet means dispense ice along a first and second respective path, said first path being separated and distinct from said second path.

14. The invention as recited in claim 11 wherein said second outlet means is operably separated from said first outlet means.

15. The invention as recited in claim 11 wherein said semi-cylindrical wall is defined by an axis, said second outlet means comprises a first and second pair of elongated slots, each said slot pair being laterally offset from a vertical plane passing through said axis, one and the other of the slots in each slot pair being disposed, respectively, proximate the forward and rearward ends of said plate.

16. The invention as recited in claim 15 wherein said cold plate is disposed at an acute angle to a horizontal plane and spaced below said semi-cylindrical wall whereby to define a cavity to be filled with ice from said slots.

17. The invention as recited in claim 16 wherein said agitator means comprises a planar frame having an end portion operably connected to said material moving means.

18. The invention as recited in claim 11 wherein said second outlet means comprises a first and second pair of slots, the slots of each pair being longitudinally spaced from each other and one and the other of the slots in each slot pair being disposed on opposite sides of an imaginary vertical plane including the axis of said semi-cylindrical wall.

19. The invention as recited in claim 11 wherein said material moving means comprises a rotor mounted against said forward end wall for rotation thereabout and about an axis extending between the forward and rearward end walls, said scoops projecting radially outwardly from the circumference of the rotor.

20. The invention as recited in claim 11 wherein said outlet chute at said second position is spaced vertically from said semi-cylindrical wall, and said second outlet means comprises said semi-cylindrical wall including a pair of elongated first slots adjacent said forward end wall and a pair of elongated second slots longitudinally rearward of said first slots.

21. The invention as recited in claim 19 wherein said agitator means comprises an axial shaft connected to a pair of ice engaging portions to define an open frame for sweeping through the ice and moving the ice relative to said semi-cylindrical wall, and further comprising means for connecting said frame to said rotor such that the axis of said axial shaft is coaxial with said axis of rotation.

22. The invention as recited in claim 11 wherein said agitator means comprises a planar frame including interconnecting beams which are adapted to engage and sweep through the ice with at least one beam being adapted to trace a path circumjacent to the semi-cylindrical wall of said hopper.

23. The invention as recited in claim 11 wherein said cold plate includes a first end portion adjacent said forward end wall and a second end portion adjacent said rearward end wall, and said second outlet means comprises slots being disposed in said semi-cylindrical wall adjacent 24. The invention as recited in claim 11 wherein the agitator means comprises a planar frame projecting from the flat disc to rotate therewith, and a plurality of ribs upstanding from the top face of said disc, said top face and ribs facing towards the rearward end wall, said ribs being adapted to engage the ice and said top face being an ice engaging face.

25. In combination with an ice dispensing machine mountable on a generally horizontal base and including an ice storage area including a forward end wall intersecting a bottom wall for supporting ice, and means defining an ice transfer path having an inlet communicable with the ice storage area and an outlet from which ice may egress, a rotor member mounted for rotation about an axis aligned at an acute angle to said base and disposed in a generally vertical plane, a plurality of material moving scoops projecting radially outward from the circumference of said rotor member to move ice within the storage area from a location adjacent the intersection of said bottom wall with said forward end wall and vertically upwardly to said outlet located at the top of the storage area, said scoops cooperating to captive material against the forward end wall as the rotor member rotates and each scoop comprising a foot and a leg, the plurality of said feet defining a plane that is generally parallel to the plane of said forward end wall and said legs being generally disposed in respective planes including the axis of rotation, and means for supporting the rotor member for rotation relative to said storage area.

26. The invention as recited in claim 25 further comprising ice agitating means connected to the rotor member and rotatable therewith for agitating the ice.

27. The invention as recited in claim 26 wherein said ice agitating means comprises a sweep arm extending from the rotor member for engaging the ice upon rotation of the rotor member, and further comprising control means for periodically causing the rotor member to rotate the sweep arm whereby to agitate the ice.

28. The invention as recited in claim 25 wherein said rotor member is one piece and has a generally flat wall portion, a V-shaped wall portion depending from said flat wall portion and forming the outer circumference of the rotor member, and said scoops are connected to said V-shaped wall portion.

29. The invention as recited in claim 28 wherein said forward end wall includes an annular V-shaped recess sized to receive said V-shaped wall portion whereby to minimize the portions of said rotor member which extend into said hopper and maximize the volume of ice that is storage in said ice storage area.

30. The invention as recited in claim 29 wherein said forward end wall includes said outlet and said scoops cooperate with said V-shaped recess and said V-shaped wall portion to define a plurality of angularly spaced pockets sized to scoop up ice and deliver the ice to said outlet.

31. The invention as recited in claim 30 wherein said ice storage area is disposed at an acute angle to a horizontal plane whereby ice normally flows by gravity towards and into abutment against said forward end wall and into one or more of the scoops, depending on the ice level in the ice storage area.

* * * * *

UNITED STATES PATENT AND TRADEMARK OFFICE

CERTIFICATE OF CORRECTION

PATENT NO. : 5,104,007

DATED : Apr. 14, 1992

INVENTOR(S) : Robert P. Utter

It is certified that error appears in the above-identified patent and that said Letters Patent is hereby corrected as shown below:

ON THE TITLE PAGE, [56] References Cited, U.S. PATENT DOCUMENTS, the following patents are missing:

| | | | | | |
|---|---|---|---|---|---|
| 3,272,300 | 9/1966 | Hoenisch | 3,858,765 | 1/1975 | Landers |
| 4,215,803 | 8/1980 | Schafer | 4,227,377 | 10/1980 | Miller |
| 4,300,359 | 11/1981 | Koeneman et al | 4,346,824 | 8/1982 | Miller et al |
| 4,423,830 | 1/1984 | Lents et al | 4,512,024 | 4/1985 | Landers |
| 4,513,892 | 4/1985 | Koeneman et al | 4,641,763 | 2/1987 | Landers et al |
| 4,753,081 | 6/1988 | Koeneman et al | | | |

Col. 6, Line 8, "13" should be --138--;

Col. 9, Line 31, Claim 20, "11" should be --19--;

Col. 9, Line 57, Claim 23, after "adjacent" insert --said end portions.--;

Col. 10, Line 19, Claim 25, "captive" should be --captivate--;

Col. 10, Line 48, Claim 29, "storage" should be --storable--.

Signed and Sealed this

Eleventh Day of January, 1994

Bruce Lehman

*Attest:*

BRUCE LEHMAN

*Attesting Officer*

*Commissioner of Patents and Trademarks*